US011454482B2

(12) United States Patent
Brown et al.

(10) Patent No.: US 11,454,482 B2
(45) Date of Patent: Sep. 27, 2022

(54) EXPLOSIVE DETONATING SYSTEM AND COMPONENTS

(71) Applicant: River Front Services, Inc., Chantilly, VA (US)

(72) Inventors: Anthony Miles Brown, Sneads Ferry, NC (US); Toby Justin Harvey, Nederland, CO (US); Donald Ray Brown, Oakton, VA (US); Thomas Jeffrey Harvey, Nederland, CO (US)

(73) Assignee: River Front Services, Inc., Chantilly, VA (US)

( * ) Notice: Subject to any disclaimer, the term of this patent is extended or adjusted under 35 U.S.C. 154(b) by 342 days.

(21) Appl. No.: 16/111,481

(22) Filed: Aug. 24, 2018

(65) Prior Publication Data

US 2019/0063892 A1 Feb. 28, 2019

Related U.S. Application Data

(60) Provisional application No. 62/549,915, filed on Aug. 24, 2017.

(51) Int. Cl.
*F42D 1/04* (2006.01)
*F42C 19/10* (2006.01)
(Continued)

(52) U.S. Cl.
CPC ..... *F42D 1/043* (2013.01); *F42C 7/12* (2013.01); *F42C 13/06* (2013.01); *F42C 19/10* (2013.01); *F42D 1/04* (2013.01)

(58) Field of Classification Search
CPC .. F42D 1/043; F42D 1/04; F42C 13/06; F42C 19/10; F42C 7/12; C06C 5/06
(Continued)

(56) References Cited

U.S. PATENT DOCUMENTS 2,687,866 A 8/1954 Johnson
2,911,910 A 11/1959 Welsh
(Continued)

FOREIGN PATENT DOCUMENTS

EP 0015067 A1 9/1980
EP 3538837 9/2019
(Continued)

OTHER PUBLICATIONS

"International Search Report & Written Opinion issued in PCT International Application No. PCT/US2020/033660 filed May 19, 2020", dated Sep. 15, 2020, 13 pages.
(Continued)

*Primary Examiner* — James S Bergin
(74) *Attorney, Agent, or Firm* — Johnson, Marcou, Isaacs & Nix, LLC

(57) ABSTRACT

An explosive detonating system comprises connectable components to connect/disconnect a pathway that ignites an explosion. A firing actuator activates primers (percussion caps). An adapter connects the firing actuator to shock tube and channels the ignition force into the shock tube. A cap box houses blasting caps coupled to the end of the shock tube. A priming well is coupled to the cap box/blasting caps and the detonating cord. When the firing actuator is initiated, the percussion caps ignite, sending an explosive wave into the adapter, which channels the wave into the shock tube and ignites the shock tube. The explosive wave travels through the shock tube and activates the blasting caps, which activate the detonating cord in the priming well. The explosive is placed in a location to provide a desired explosive effect. For example, the system may be employed as a system to breach structures or other applications.

20 Claims, 13 Drawing Sheets

(51) Int. Cl.
*F42C 13/06* (2006.01)
*F42C 7/12* (2006.01)

(58) Field of Classification Search
USPC ..... 102/204, 275.12
See application file for complete search history.

(56) References Cited

U.S. PATENT DOCUMENTS

| | | | | |
|---|---|---|---|---|
| 2,923,239 | A * | 2/1960 | Andrew | C06C 5/06 102/275.4 |
| 3,169,478 | A | 2/1965 | Schaaf | |
| 3,320,883 | A | 5/1967 | Martin | |
| 3,327,979 | A | 6/1967 | Akio | |
| 3,354,827 | A * | 11/1967 | Nelson | F42B 3/00 102/318 |
| 3,374,737 | A | 3/1968 | Pike | |
| 3,431,574 | A | 3/1969 | Mathieu | |
| 3,782,284 | A | 1/1974 | Gibb | |
| 3,783,787 | A | 1/1974 | Thornley et al. | |
| 4,015,506 | A | 4/1977 | Musgrave | |
| 4,187,780 | A * | 2/1980 | Petruccelli | F42D 1/043 102/275.12 |
| 4,334,476 | A * | 6/1982 | Day | F42B 3/00 102/275.12 |
| 4,381,711 | A | 5/1983 | Lawrence | |
| 4,408,535 | A | 10/1983 | Alford | |
| 4,499,828 | A | 2/1985 | Honodel | |
| 4,813,358 | A | 3/1989 | Roberts | |
| 4,856,430 | A | 8/1989 | Gibb et al. | |
| 4,957,027 | A | 9/1990 | Cherry | |
| 5,012,741 | A | 5/1991 | Peebles | |
| 5,020,435 | A | 6/1991 | Cawte | |
| 5,036,588 | A | 8/1991 | Cherry | |
| 5,171,935 | A * | 12/1992 | Michna | C06C 5/06 102/275.12 |
| 5,417,162 | A * | 5/1995 | Adams | F42D 1/043 102/317 |
| 5,499,581 | A | 3/1996 | Sutula, Jr. | |
| 5,661,256 | A * | 8/1997 | Sutula, Jr. | C06C 5/06 102/275.4 |
| 5,703,320 | A | 12/1997 | Lucca | |
| 5,714,712 | A | 2/1998 | Ewick | |
| 6,006,671 | A | 12/1999 | Yunan | |
| 6,581,519 | B1 | 6/2003 | Adams | |
| 6,681,701 | B2 | 1/2004 | Perry | |
| 7,490,554 | B2 | 2/2009 | Lynch | |
| 7,665,401 | B2 | 2/2010 | Ballantine | |
| 7,765,932 | B2 | 8/2010 | Allman | |
| 7,802,509 | B2 | 9/2010 | Wall | |
| 7,819,063 | B1 | 10/2010 | Lehman | |
| 7,926,423 | B2 | 4/2011 | Rickman et al. | |
| 7,934,292 | B2 | 5/2011 | Degner et al. | |
| 8,006,621 | B1 | 8/2011 | Cherry | |
| 8,127,682 | B1 * | 3/2012 | Sonday | F42B 33/0207 102/275.4 |
| 8,194,403 | B2 | 6/2012 | Liu | |
| 8,267,013 | B2 | 9/2012 | Moore | |
| 8,402,892 | B1 | 3/2013 | Scheid | |
| 8,826,821 | B2 | 9/2014 | Martin | |
| 8,904,937 | B2 | 12/2014 | Mangolds | |
| 8,973,502 | B2 * | 3/2015 | Scheid | F42D 1/043 102/275.12 |
| 9,709,213 | B2 | 7/2017 | Zheng | |
| 9,791,247 | B2 | 10/2017 | Parker | |
| 9,857,831 | B2 | 1/2018 | Senatori et al. | |
| 9,909,035 | B1 | 3/2018 | Caldeira | |
| 2001/0055540 | A1 | 12/2001 | Bonamarte | |
| 2005/0092877 | A1 | 5/2005 | Carnevali | |
| 2005/0126420 | A1 | 6/2005 | Givens et al. | |
| 2005/0179724 | A1 | 8/2005 | Salt et al. | |
| 2007/0125256 | A1 * | 6/2007 | Frickey | F42D 1/045 102/205 |
| 2011/0072956 | A1 | 3/2011 | Wall | |
| 2011/0197779 | A1 | 8/2011 | Moore | |
| 2012/0073155 | A1 | 3/2012 | Mabey | |
| 2012/0074291 | A1 | 3/2012 | Fu | |
| 2012/0106043 | A1 | 5/2012 | Murakata et al. | |
| 2012/0145027 | A1 | 6/2012 | Martin | |
| 2014/0048672 | A1 | 2/2014 | Woodruff et al. | |
| 2015/0008302 | A1 | 1/2015 | Fan | |
| 2015/0092427 | A1 | 4/2015 | Nopper | |
| 2015/0108313 | A1 | 4/2015 | Leung | |
| 2015/0184799 | A1 | 7/2015 | Whitney | |
| 2015/0292672 | A1 | 10/2015 | Dose | |
| 2016/0134733 | A1 | 5/2016 | Murphy et al. | |
| 2016/0202033 | A1 * | 7/2016 | Shahinpour | E21B 43/1185 102/206 |
| 2016/0226126 | A1 | 8/2016 | Daton-Lovett | |
| 2016/0286016 | A1 | 9/2016 | Lee et al. | |
| 2017/0223862 | A1 | 8/2017 | Justiss et al. | |
| 2018/0128419 | A1 | 5/2018 | Brown et al. | |
| 2019/0103650 | A1 | 4/2019 | Daton-Lovett | |
| 2020/0002242 | A1 | 1/2020 | Brown | |
| 2020/0132247 | A1 | 4/2020 | Brown | |
| 2020/0284570 | A1 | 9/2020 | Brown | |
| 2021/0254955 | A1 * | 8/2021 | O'Hara | F42D 1/043 |

FOREIGN PATENT DOCUMENTS

| | | | | |
|---|---|---|---|---|
| EP | 3673227 | A2 | 7/2020 | |
| EP | 3940334 | A1 * | 1/2022 | F42C 13/06 |
| FR | 2300325 | A1 | 9/1976 | |
| GB | 1415204 | A | 11/1975 | |
| WO | 9600879 | A1 | 1/1996 | |
| WO | 2008045118 | A2 | 4/2008 | |
| WO | WO 2008/045118 | | 4/2008 | |
| WO | WO 2013/175243 | A2 | 11/2013 | |
| WO | 2018089530 | A1 | 5/2018 | |
| WO | 2019199346 | A2 | 10/2019 | |
| WO | 2020055500 | A2 | 3/2020 | |
| WO | 2020236848 | A1 | 11/2020 | |

OTHER PUBLICATIONS

"Office Action issued in U.S. Appl. No. 16/457,742, filed Jun. 28, 2019", dated Sep. 28, 2020.
"Extended European Search Report for European Patent Application No. 17869384.2", dated Jul. 13, 2020, 8 pages.
"International Search Report and Written Opinion issued in International Patent Application No. PCT/US2018/047861, dated Jan. 24, 2020, filed Aug. 24, 2018", 20 pages.
Madeira, "Invitation to Pay Additional Fees issued in International Patent Application No. PCT/US2018/047861 filed Aug. 14, 2018", dated Nov. 21, 2019, 15 pages.
"Gryphon Engineering Services, Gryphon Engineering I Folding Entry Prop Pole (4 Piece), web page as of Oct. 3, 2016.".
"Office Action issued in U.S. Appl. No. 16/729,012, filed Dec. 27, 2019", dated Apr. 14, 2020, 15 pages.
U.S. Appl. No. 16/729,012 to Brown et al. filed Dec. 27, 2019.
U.S. Appl. No. 15/807,274 to Brown et al. filed Nov. 8, 2017.
U.S. Appl. No. 16/457,742 to Brown et al. filed Jun. 28, 2019.
"Ensign-Bickford Aerospace & Defense, Rapid Wall Breaching Kit, web page as of Oct. 3, 2016."
"Final Office Action issued in U.S. Appl. No. 15/807,274, filed Nov. 8, 2017", dated Apr. 11, 2019, 17 pages.
"International Search Report and Written Opinion PCT/US2017/060685", dated Jan. 22, 2018, 9 pages.
"Notification of Transmittal of international Preliminary Report on Patentability (Chapter II of the Patent Cooperation Treaty) and International Preliminary Report on Patentability (Chapter II of the Patent Cooperation Treaty) for PCT/US2017/060685", dated Oct. 19, 2018, 9 pages.
"Notification of Transmittal of International Preliminary Report on Patentability (Chapter II), and Communication in Cases for Which No Other Form is Applicable for PCT/US2017/060685", dated Dec. 3, 2018, 14 pages.
"Office Action issued in U.S. Appl. No. 15/807,274, filed Nov. 8, 2017", dated Aug. 27, 2018, 21 pages.

(56) References Cited

OTHER PUBLICATIONS

"International Search Report and Written Opinion issued in International Patent Application No. PCT/US2019/039991 filed Jun. 28, 2019", dated Jun. 8, 2020, 16 pages.
Lou, et al., "A Combined Analytical and Experimental Study on Space Inflatable Booms", Aerospace Conference Proceedings, 2000, IEEE, Mar. 18-25, 2000 vol. 2, Mar. 18, 2000, 503-511.
"Communication under Rule 71(3) EPC, Intention to Grant, in Application No. EP 18908272.0 dated Mar. 16, 2021".
"Decision to grant a European patent pursuant to Article 97(1) EPC in Application No. EP 18908272.0 dated May 28, 2021", 2 pages.
"Ideal Blasting Supply; Detonating Cord Connectors 50/25 Grain (Bag of 50), web page as of Jan. 18, 2021", https://idealblasting.com/det-cord-connectors-50-25-grain-bag-of-50/, 3 pages.
"Inert Products, LLC; Raptor Combo Connector (Det Cord Connector) web page as of Jan. 18, 2021", https://inertproducts.com/product/raptor-combo-connector/, 2 pages.
"Optactical.com; ITW Nexus Quick Cap Connector—CDDI—Dual Detonation Instantaneous; web page as of Jan. 18, 2021", https://www.optactical.com/itwnequcapco3.html.
"Extended European Search Report", issued by the European Patent Office for EP Application No. 21180779.7, 8 pages.
"International Preliminary Report on Patentability issued in PCT International Application No. PCT/US2020/033660 filed May 19, 2020", dated Dec. 2, 2021, 10 pages.
Semick, "Non-Final Office Action issued in U.S. Appl. No. 16/878,450, filed May 19, 2020", 65 pages.

* cited by examiner

EXPLOSIVE DETONATING SYSTEM AND COMPONENTS

CROSS REFERENCE TO RELATED APPLICATIONS

This application claims priority to U.S. Provisional Patent Application No. 62/549,915 filed Aug. 24, 2017 and titled "Breaching System." The entire contents of the above-identified priority application are hereby fully incorporated herein by reference.

TECHNICAL FIELD

The invention described herein relates to an explosive detonating system and, more particularly, to an explosive detonating system having one or more connectable components to connect/disconnect the pathway that initiates an explosion.

BACKGROUND

Explosives are used in many modern-day applications. For example, explosives are used in building or other demolition, earth movement for construction, and military applications. Military and law enforcement applications include breaching doors, walls, bulkheads, and other structures. For example, the goal may be to gain rapid entry to a fortified compound or to remove an obstacle for a tactical advantage. In operation, explosives are placed in position and then detonated from a safe distance.

In a conventional explosive initiation sequence, an ignition device, such as a pen flare gun, is utilized to ignite a main explosive charge. The ignition device fires percussion caps, for example shot gun primers, to initiate the explosive process. The shotgun primers transmit an initiating signal along a stand-off device, such as electrical wire, "shock-tube," time fuse, or detonating cord to a blasting cap. When activated by the initiating signal, the blasting cap detonates the main explosive charge.

The shock tube allows a user to distance himself from the main explosive charge and also to lower the amount of explosive needed to detonate a charge. The shock tube may be a shock tube, such as NONEL®. Shock tube is a hollow extruded tube containing a thin layer of energetic materials on its inner diameter. Once initiated, the shock tube transmits a signal to a detonating output charge, typically incorporating an instantaneous output or a pre-determined delay. Such a shock tube is "non-electric," so an electric current is not transmitted to the detonator.

In conventional systems, detonators, such as blasting caps, are crimped onto one end of the shock tube. When the firing impulse is delivered from the primers, the shock tube ignites the blasting caps. The blasting caps are taped or affixed to a loop of detonating cord or directly to the explosive charge. Detonating cord typically is a flexible plastic tube filled with an explosive material, such as PETN or similar explosive material. The blasting caps ignite the explosive material in the detonating cord, which explodes along the length of the cord to ignite the main explosive charge.

In conventional systems, a user is in proximity to the explosives throughout the configuration, transportation, and deployment process. The systems are typically configured at a central location and transported assembled to a desired location. If the pen flare gun accidentally fires a primer, such as during transport, the entire explosive sequence starts, resulting in an explosion that may injure the operator(s) and/or compromise the mission. Additionally, in conventional systems, when an operator desires to perform multiple detonations, the operator must transport multiple pen flare guns attached to multiple, independent explosive systems.

SUMMARY

This description relates to an explosive detonating system having one or more connectable components to connect/disconnect the pathway that ignites an explosion. The components comprise a firing actuator that activates primers (percussion caps), an adapter that connects the firing actuator to shock tube and channels the ignition force into the shock tube, a cap box that houses blasting caps coupled to the end of the shock tube, and a priming well that is coupled to the blasting caps and the detonating cord. When the firing actuator is initiated, the percussion caps ignite sending an explosive wave into the adapter, which channels the wave into the shock tube and ignites the shock tube. The explosive wave travels through the shock tube and activates the blasting caps housed in the cap box and inserted into the priming well, which activate the detonating cord in the priming well. Then, the detonating cord activates a main explosive charge. The main explosive charge is placed in a location to provide a desired effect from the resulting explosion. For example, the system may be employed as a breaching system to breach structures or other suitable applications.

These and other aspects, objects, features, and advantages of the invention will become apparent to those having ordinary skill in the art upon consideration of the following detailed description of illustrated examples.

DETAILED DESCRIPTION

Figure 1:
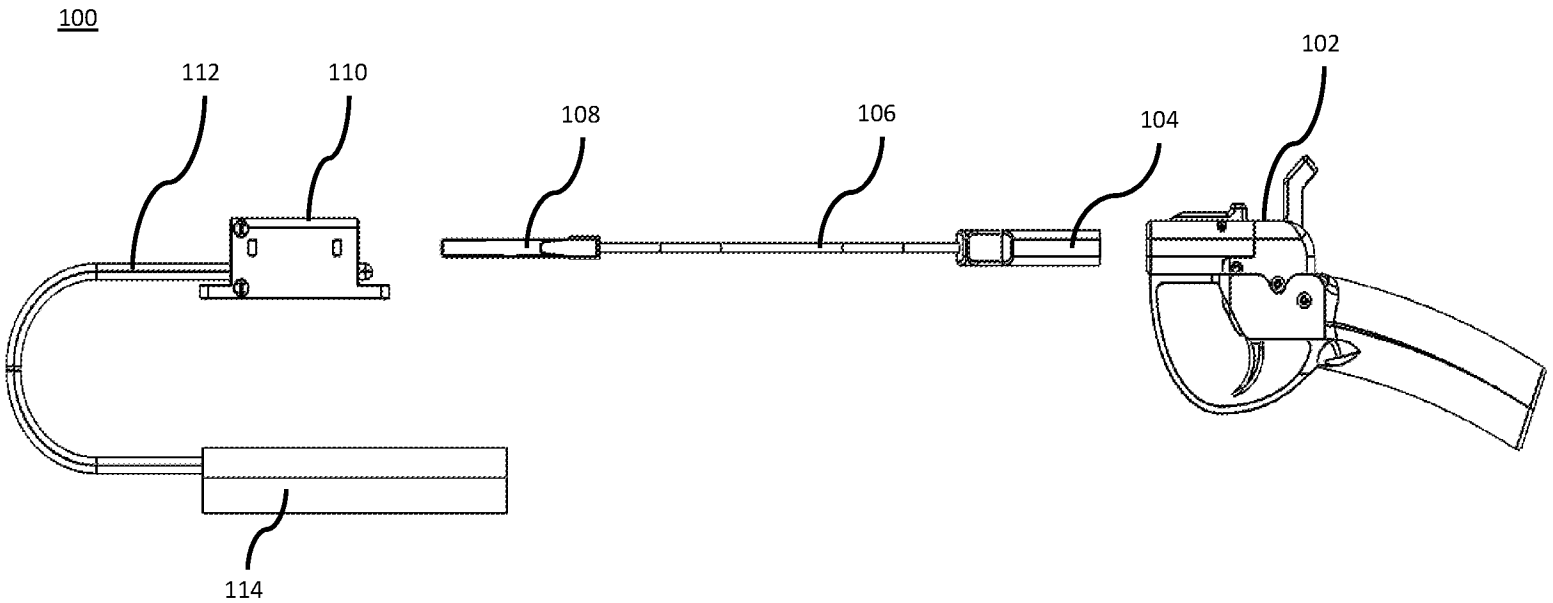
FIG. 1 is an assembly drawing depicting components of the explosive detonating system in exploded form, in accordance with certain examples.

Turning now to the drawings, in which like numerals represent like (but not necessarily identical) elements throughout the figures, the innovations are described in detail.

This description relates to an explosive detonating system having one or more connectable components to connect/disconnect the pathway that ignites an explosion. The components comprise a firing actuator that activates primers (percussion caps); an adapter that connects the firing actuator to shock tube and channels the ignition force into the shock tube; a cap box that houses the blasting caps coupled to the end of the shock tube; and a priming well that is coupled to detonating cord or an explosive charge or material. When the firing actuator is initiated, the percussion caps ignite sending an explosive wave into the adapter, which channels the wave into the shock tube and ignites the shock tube. The explosive wave travels through the shock tube and activates the blasting caps housed in the cap box and inserted into the priming well, which activate the detonating cord in the priming well. Then, the detonating cord activates a main explosive charge. The main explosive charge is placed in a location to provide a desired effect from the resulting explosion. For example, the system may be employed as a breaching system to breach structures or other suitable applications.

The explosive detonating system includes a quick connect/disconnect between the primer firing actuator and the shock tube. This part of the explosive detonating system comprises the firing actuator, primers, and an adapter cartridge that connects one end of the shock tube to the firing actuator.

The explosive detonating system also includes a quick connect/disconnect between the blasting caps coupled to the other end of the shock tube and the detonating cord that is attached to the main explosive charge. This part of the explosive detonating system includes a cap box and a priming well.

The explosive detonating system can allow an operator to easily and quickly connect/disconnect the components. In this manner, the operator can transport or store a disassembled explosive system that is not in a position to fire accidentally. Then, the operator can connect the system components together when desired with minimal delay. For example, the operator can connect the components of the system when at a location to be breached, thereby not transporting an armed system that could fire accidentally.

The explosive detonating system also can reduce a possibility of the explosive system initiating prematurely compared to conventional systems, which lessens the danger to the operator and bystanders. This benefit is created because the explosive detonating system is disconnected between the primer firing actuator and the shock tube, as well as between the blasting caps and the detonating cord until the operator is ready to initiate the main explosive charge.

Additionally, a single firing actuator for firing the blasting caps can be used for multiple explosive detonating systems. The reusable firing actuator described herein lessons the burden of transporting multiple firing actuators, or other shock tube initiators, to the breaching location.

Figure 2:
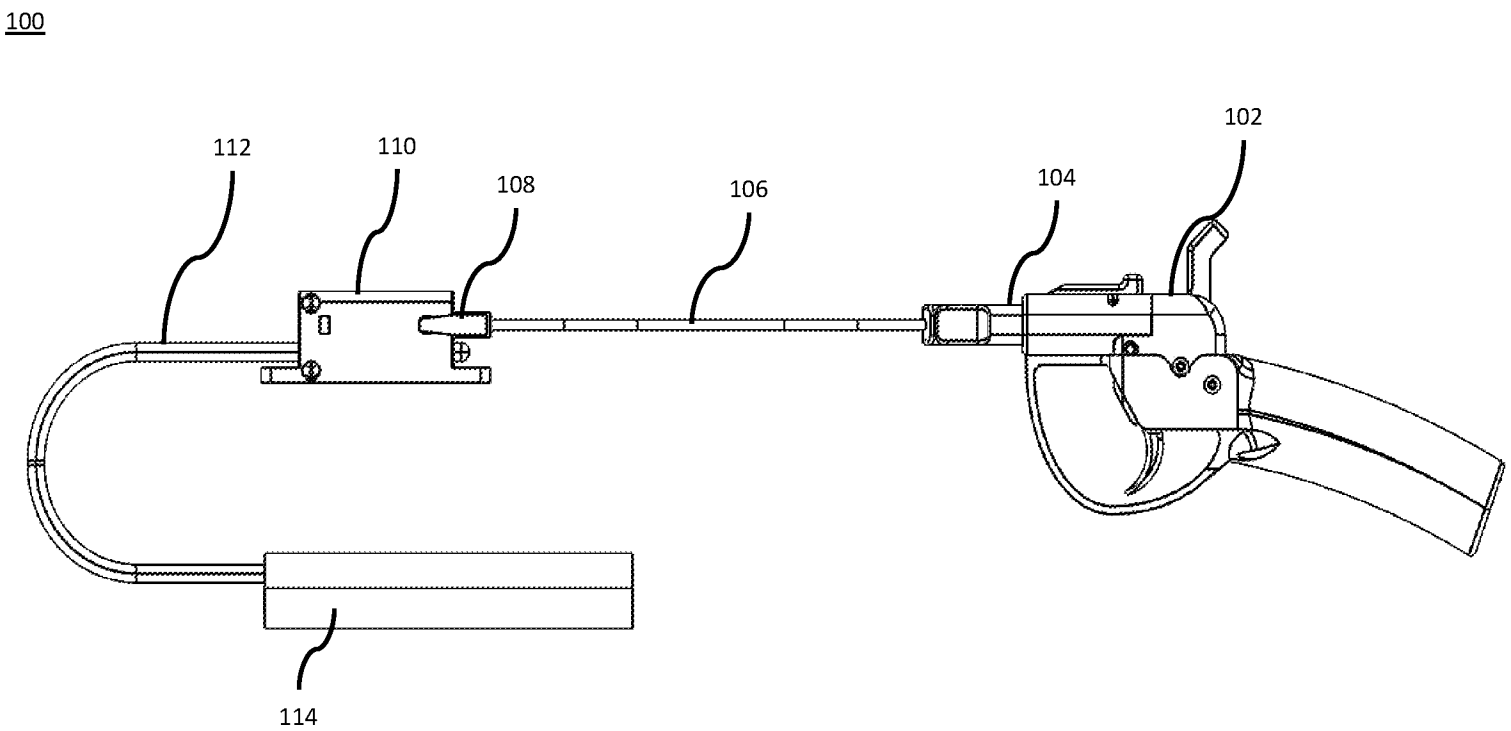
FIG. 2 is an illustration depicting the assembled explosive detonating system, in accordance with certain examples.

FIGS. 1 and 2 are illustrations depicting an explosive detonating system 100, in accordance with certain examples. FIG. 1 is an assembly drawing depicting components of the explosive detonating system 100 in exploded form, in accordance with certain examples. FIG. 2 is an illustration depicting the assembled explosive detonating system 100, in accordance with certain examples.

Figure 4:
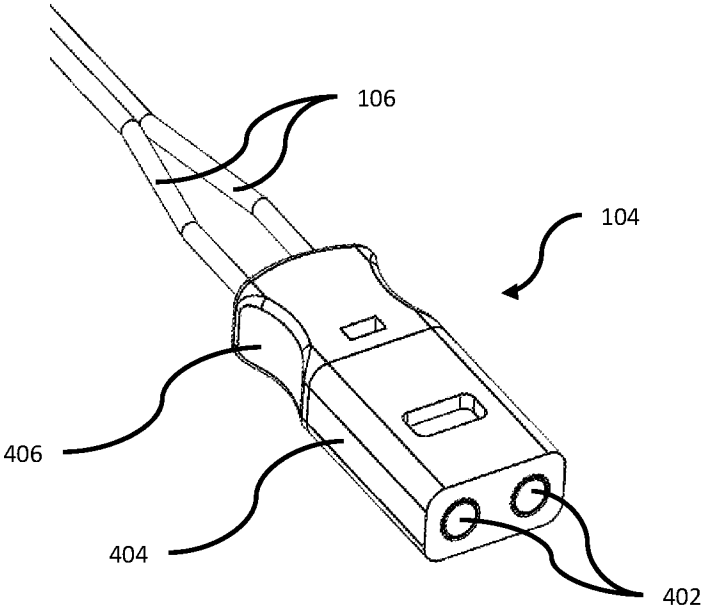
FIG. 4 is a perspective view depicting a shock tube adapter, in accordance with certain examples.

The explosive detonating system 100 comprises a firing actuator 102 that activates one or more primers (not visible in FIGS. 1 and 2; see item 402 of FIG. 4).

A shock tube adapter 104 connects the firing actuator 102 to one end of shock tube 106. The shock tube 106 is inserted into one end of the shock tube adapter 104. The shock tube 106 typically comprises two tubes for redundancy. One or both of the tubes can be uses as desired. The other end of the shock tube adapter 104 is insertable into and removable from the firing actuator 102 and mechanically locks to the firing actuator 102. The shock tube adapter 104 provides a connect/disconnect between the primers and the shock tube 106 and the primers/shock tube 106 and the firing actuator 102. Although not depicted in FIG. 1, the shock tube adapter can comprise a removeable cap that covers and protects the primers from being struck during transport. The cap can be formed from a plastic, rubber, or other suitable material.

Blasting caps (not visible in FIGS. 1 and 2; see item 802 of FIG. 8) are connected to the other end of the shock tube 106. For example, the blasting caps can be crimped or otherwise mechanically fastened to the shock tube 106.

As depicted in FIGS. 1 and 2, the blasting caps can be inserted into a cap box 108. The cap box 108 protects the blasting caps during storage and/or transport of the blasting caps. Additionally, the cap box 108 facilitates coupling the blasting caps to detonating cord 112 via a priming well 110. Although not depicted in FIG. 1, the cap box can comprise a removeable cap or other cover that covers and protects the blasting caps from being struck during transport. The cap can be formed from a plastic, rubber, or other suitable material.

The priming well 110 retains the blasting caps on the shock tube 106 in proximity to the detonating cord 112. The blasting caps and one end of the detonating cord are inserted into the priming well 110. The priming well 110 is designed such that insertion of the blasting caps and the detonating cord 112 into the priming well 110 fixes the blasting caps and the detonating cord 112 in close proximity. For example, the blasting caps and the detonating cord 112 can be inserted into the priming well 110 such that the blasting caps are close enough to the detonating cord 112 to initiate the detonating cord 112 when the blasting caps are initiated. The priming well 110 can retain the blasting caps in contact with the detonating cord 112 prior to initiation of the blasting caps. In this configuration, initiation of the detonating cord 112 by the blasting caps is more reliable. However, the priming well 110 also may retain the blasting caps in proximity to the detonating cord 112 without physical contact between the blasting caps and the detonating cord 112. In this configuration, the gap between the blasting caps and the detonating cord 112 is maintained at a distance that is not more than a distance that will allow the blasting caps to initiate the detonating cord 112.

The other end of the detonating cord 112 is coupled to a main explosive charge 114. The main explosive charge 114 may not be utilized if the explosive force of the detonating cord 112 is sufficient to achieve the desired result.

The priming well 110 provides a connect/disconnect between the blasting caps coupled to the shock tube 106 and the detonating cord 112 that is attached to the main explosive charge 114.

In operation, initiation of the primers by the firing actuator 102 introduces an explosive ignition wave from the primers into the shock tube 106, via the shock tube adapter 104. The explosive wave traveling through the shock tube 106 initiates the blasting caps, which are held in proximity to the detonating cord 112 via the priming well 110. Initiation of the blasting caps initiates the detonating cord 112. Then, the detonating cord 112 initiates the main explosive charge 114.

Figure 3:
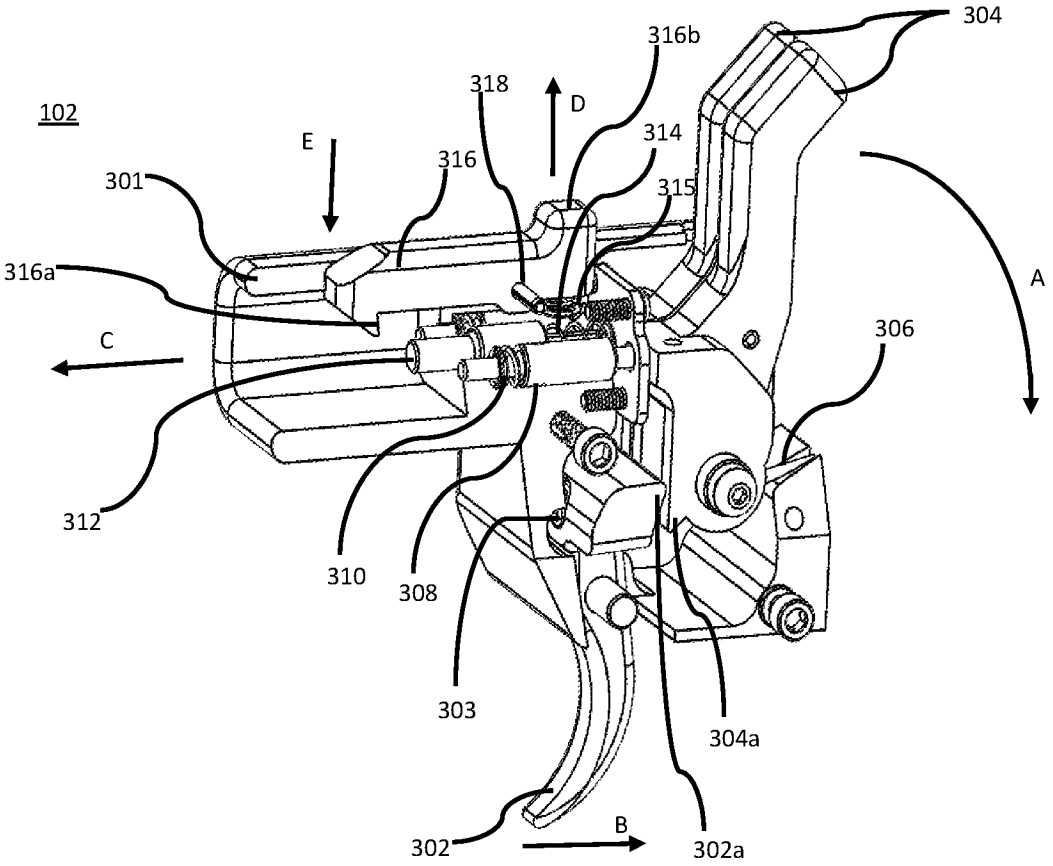
FIG. 3 is a perspective, cut-out view depicting a firing actuator or device or shock tube initiator, in accordance with certain examples.

The firing actuator 102 will now be described with reference to FIG. 3. FIG. 3 is a perspective, cut-out view depicting a firing actuator 102, in accordance with certain examples.

The firing actuator 102 comprises a housing 301 in which multiple components are positioned. A trigger 302 that works in conjunction with one or more hammers 304 mechanically moves one or more corresponding firing pins 308. A trigger reset spring 303 biases an upper portion of the trigger 302 toward the hammers 304.

As shown in FIG. 3, the hammers 304 are depicted in a "safe" position. As the hammers 304 are cocked by movement in direction A, a lower portion of the hammers 304 pushes an upper portion of the trigger 302 against the trigger 302 reset spring until the hammers 304 lock in the cocked position via engagement of the components 302*a* of the trigger 302 and 304*a* of the hammers 304. A hammer torsion spring 306 biases the hammers 304 in a direction opposite of the direction A. The trigger 302 and hammers 304 are held in the cocked position by the biasing force of the trigger reset spring 303 and the hammer torsion spring 306 that engage the components 302*a* of the trigger 302 and 304*a* of the hammers 304.

When the operator pulls the trigger 302 in the direction B, the upper portion of the trigger 302 moves away from the lower portion of the hammers 304 thereby disengaging the components 302*a* of the trigger 302 and 304*a* of the hammers 304. The biasing force of the hammer torsion spring 306 moves the hammers 304 in a direction opposite the direction A with sufficient force to move one or more corresponding firing pins 308 in a direction C. Corresponding firing pin reset springs 310 bias the firing pins 308 in a direction opposite the direction C. As the hammers 304 move in the direction opposite of direction A, the hammers 304 strike the corresponding firing pins 308 with a force sufficient to overcome the biasing force of the firing pin reset springs 310 to cause the firing pins 308 to contact one or more primers (not depicted in FIG. 3) positioned adjacent to the firing pins 308. Another version of the firing actuator 102 comprises a double-action trigger system. In this case, the hammers 304 do not have to be cocked. Pulling the trigger 302 will initially move the hammers 304 in the direction A. Further pulling of the trigger 302 will then release the hammers 304 to move in the direction opposite the direction A to actuate the primers. Additionally, multiple triggers 302 may be provided such that each hammer 304 has a corresponding trigger 302 that actuates that hammer 304.

Although not depicted in FIG. 3, a hammer and firing pin may be combined into a single component. For example, the hammer may have a firing pin formed as part of the hammer. In operation of this design, when the hammer is released from the cocked position, the firing pin on the hammer directly strikes the primer. This operation contrasts to the hammer striking the firing pin, and then the firing pin striking the primer. The firing pin reset springs 310 may be omitted in this design. A single hammer may have two integrally formed firing pins. Two hammers having corresponding integrally formed firing pins may also be utilized.

An ejection latch 316 and ejection pin 312 allow insertion and removal of the shock tube adapter 104 into the firing actuator 102. The ejection latch 316 pivots around a pin 318 coupled to the housing 301. An ejection latch spring 315 biases one end of the ejection latch 316 around the pin 318 in a direction D, which biases an opposite end of the ejection latch 316 in a direction E. As the shock tube adapter 104 is inserted into the firing actuator 102, the shock tube adaptor 106 contacts a tab 316*a* on the ejection latch 316. This contact moves the tab 316*a* of the ejection latch 316 in a direction opposite to direction E, which moves the opposite end 316*b* of the ejection latch 316 around the pin 318 in a direction opposite of the direction D and against the biasing force of the ejection latch spring 315. When the shock tube adapter 104 is inserted fully into the firing actuator 102, the biasing force of the ejection latch spring 315 moves the corresponding end 316*b* of the ejection latch 316 in the direction D, which moves the tab 316*a* in the direction E to engage with a retaining indent (not illustrated in FIG. 3; see item 504*c* of FIG. 5) of the shock tube adapter 104. This engagement locks the shock tube adapter 104 in position in the firing actuator 102. Additionally, when the shock tube adapter 104 is inserted into the firing actuator 102, the shock tube adaptor 104 moves the ejection pin in a direction opposite the direction C against a biasing force of an ejection spring 314.

Although not depicted in FIG. 3, the ejection pin and ejection spring may be replaced with an ejection spring that pushes directly on the shock tube adapter 104. This ejection spring may be fixed in place such that insertion of the shock tube adapter 104 compresses the ejection spring, and the biasing force of the ejection spring pushes the shock tube adapter 104 from the firing actuator 102 when the ejection latch 316 is released.

To remove the shock tube adapter 104 from the firing actuator 102, the operator pushes an end 316*b* of the ejection latch 316 in a direction opposite the direction D against the biasing force of the ejection latch spring 315. This operation moves the tab 316*a* of the ejection latch 316 in a direction opposite to the direction E to disengage the tab 316*a* of the ejection latch 316 from the retaining indent of the shock tube 106 adaptor. The biasing force of the ejection spring 314 moves the ejection pin 312 in the direction C to push the shock tube adaptor 104 from the firing actuator 102.

Various options for implementing the firing actuator 102 are suitable. For example, the firing actuator 102 may comprise a single hammer or multiple hammers 304 and a corresponding single firing pin or multiple firing pins 308. Additionally, a single hammer may be sized to contact both firing pins. If two hammers are utilized, they may be linked together to operate as a single hammer. For example, a pin may be inserted through apertures or slots in both hammers to link the two hammers together. In this case, movement of one hammer results in corresponding movement of the other hammer. The pin can be slideable from one hammer into the other hammer, such that operation of one hammer independently of the other hammer is possible if desired and operation of both hammers as a single unit is possible if desired. Other mechanisms for releasing the hammers 304 from the cocked position may be utilized. If the ejection spring 314 and ejection pin 312 are not used, the operator may manually pull the shock tube adapter 104 from the firing actuator 102. Other latching arrangements may be utilized to retain the shock tube adapter 104 in the firing actuator 102. For example, the ejection latch 316 and ejection latch spring 315 may be positioned on the shock tube adapter 104 to engage with a corresponding retaining indent on the firing actuator 102. The ejection latch 316 may be integral to the firing actuator 102 or the shock tube adapter 104. In this case, the ejection latch spring 315 may be omitted because the elastic force of the ejection latch 316 will bias the ejection latch 316 in position. One or multiple ejection latches may be used.

The firing device comprises two independent firing sides operated at least by one trigger 302. The operator can cock both hammers 304 or one hammer, and the single trigger 302 will release one hammer 304 or both hammers 304 simultaneously, depending on the number of cocked hammers. This operation allows the operator to use one initiating device for either single or dual primed charges.

Figure 5:
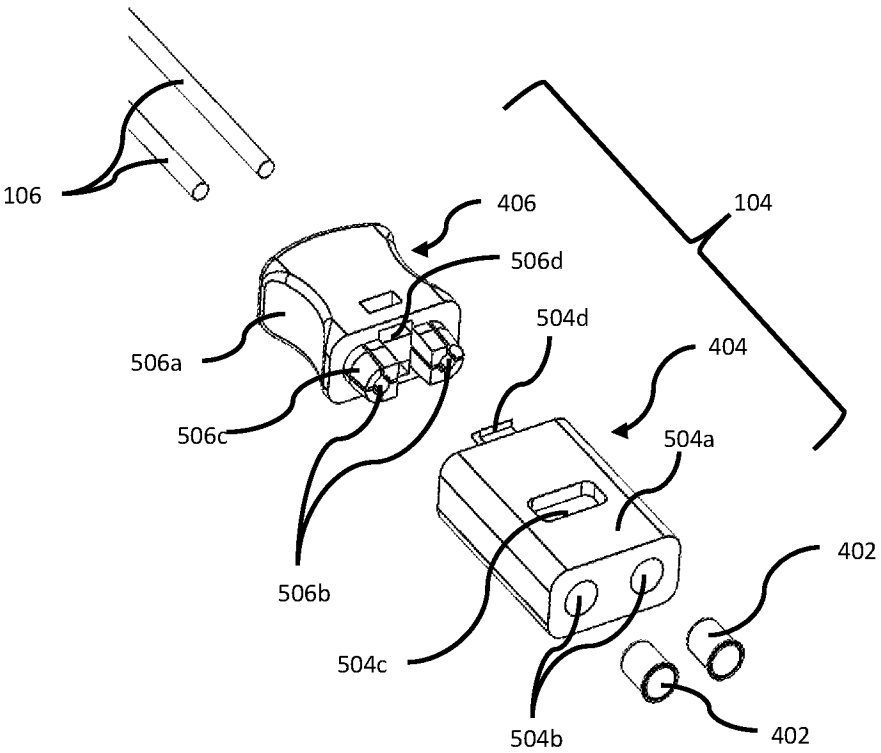
FIG. 5 is a perspective view showing assembly of a two-piece shock tube adapter and shock tube, in accordance with certain examples.

The shock tube adapter 104 will now be described with reference to FIGS. 4 and 5. FIG. 4 is a perspective view depicting a shock tube adapter 104, in accordance with certain examples. FIG. 5 is a perspective view showing assembly of a two-piece shock tube adapter 104 and shock tube 106, in accordance with certain examples.

As shown in FIGS. 4 and 5, the shock tube adapter 104 comprises a primer case 404 and a shock tube case 406. The shock tube 106 is inserted into and retained by the shock tube case 406. Primers are inserted into the primer case 404. The shock tube case 406 and the primer case 404 couple together to form the shock tube adapter 104.

With reference to FIG. 5, the primer case 404 comprises a primer housing 504*a* having continuous apertures 504*b* extending through the primer housing 504*a*. The apertures 504*b* are sized to receive the primers 402. The apertures 504*b* may retain the primers 402 therein via compression fit. The primers 402 also may be adhered into the apertures 504*b*, mechanically retained therein, or otherwise fixed in position. For example, a retainer clip may be utilized to retain the primers 402 in the apertures 504*b*. The primer apertures 504*b* open into an expansion chamber (not visible in FIG. 5; see item 702 of FIG. 7) leading to both shock tubes, thereby allowing either primer charge to initiate one or both shock tubes.

The primer case 404 further comprises a retaining indent 504*c*. The retaining indent 504*c* receives the tab 316*a* of the ejection latch 316 of the firing actuator 102 (as described previously with reference to FIG. 3) when the shock tube adapter 104 is inserted into the firing actuator 102 (as described previously with reference to FIG. 3).

The primer case 404 further comprises at least one retaining tab 504*d*. The tab 504*d* engages a corresponding retaining indent 506*d* in the shock tube case 406 to latch the primer case 404 and the shock tube case 406 together. While only one tab 504*d* is visible, the primer case 404 may include multiple tabs 504*d*. For example, the primer case 404 may include two tabs 504*d* on the top and bottom of an end that faces the shock tube case 406. Alternatively, the tabs may be located on the shock tube case 406 and engage with corresponding indents or apertures on the primer case 404.

The shock tube case 406 comprises a shock tube housing 506*a* having continuous apertures 506*b* extending through the shock tube housing 506*a*. The apertures 506*b* are sized to receive the shock tube 106.

The shock tube case 406 further comprises tabs 506*c* around the apertures 506*b*. The shock tube 106 is inserted into the apertures 506*b* at one end of the shock tube case 406, pushed through the apertures 506*b* of the shock tube case 406, and at least partially engage in the tabs 506*c* on an opposite end of the apertures 506*b* in the shock tube case 406. The shock tube 106 may extend past the tabs 506*c* of the shock tube case 406.

The tabs 506*c* are sized around the apertures 506*b* to allow the shock tube 106 to pass therethrough. The tabs 506*c* are further sized to mate in the aperture 504*b* of the primer case 404 when the shock tube case 406 and the primer case 404 are attached together. As the tabs 506*c* are inserted into the apertures 504*b* of the primer case 404, the apertures 504*b* compress the tabs 506*c* of the shock tube case 406 toward the center of the apertures 506*b* of the shock tube case 406. This movement clamps the tabs 506*c* of the shock tube case 406 around the shock tube 106 in the apertures 506*b* to retain the shock tube 106 in the shock tube case 406. The apertures 506*b* may retain the shock tube 106 therein via compression fit without extending into the tabs 506*c*.

Connecting the shock tube case 406 and the primer case 404 connects the apertures 506*b* of the shock tube case 406 with the apertures 504*b* of the primer case 404 to thereby create a continuous path from the primers 402 through the apertures 504*b* (and sometimes at least part of the apertures 506*b*) to the shock tube 106. In this manner, an explosive wave created by initiation of the primers 402 can travel to the shock tube 106. In one design, the primer case 404 comprises an expansion chamber 702 (see FIG. 7) that connects the apertures 504*b* of the primer case 404 with the apertures 506*b* of the shock tube case 406. Both apertures 504*b* open into the expansion chamber 702, and both apertures 506*b* open into the expansion chamber 702. Accordingly, the expansion chamber 702 funnels the blast from a single percussion cap 402 to both apertures 506*b* to initiate both lines of shock tube 106. Thus, if only one primer fires, the expansion chamber 702 funnels the blast to both lines of shock tube to ensure a dual system ignition. The expansion chamber is optional, and each aperture 504*b* may directly connect to a respective one of the apertures 506*b*. In this case, each primer 402 will activate only a corresponding one of the shock tubes 106.

The shock tube case 406 further comprises one or more retaining indents 506*d* that correspond with the retaining tabs 504*d* of the primer case 404. The retaining indents 506*d* receive the retaining tabs 504*d* to connect the shock tube case 406 to the primer case 404. The operator can push the retaining tabs 504*d* from engagement with the retaining indents 506*d* to disconnect the shock tube case 406 from the primer case 404.

Various options for implementing the shock tube adapter 104 are suitable. For example, the primer case 404 and shock tube case 406 may be formed integrally as a single piece. In this case, the apertures can be continuous from the end in which the primers 402 are inserted to the opposite end in which the shock tube 106 is inserted. This design also can incorporate the expansion chamber 702 between the primer end and the shock tube end of the primer case 404. The apertures for receiving the shock tube 106 can be tapered from the end in which the shock tube 106 is inserted to a smaller area inside the shock tube case 406 or the shock tube adapter 104. In this case, the shock tube adapter 104 retains the shock tube 106 via compression as the shock tube 106 is inserted into the shock tube adapter 104.

The two-piece design of the shock tube adapter 104 allows a further separation of the primers 402 from the blasting caps, detonating cord 112, and the main explosive charge 114. The primer case 404 can be removed from the shock tube adapter 104 to disconnect the primers 402 from the system. The primer also can be carried separately and connected to the shock tube case 406 on location. In another instance, the shock tube adapter can also be a single assembly device in which percussion caps are inserted or press fitted into the firing device end and shock tube is inserted into the explosive end and secured with either a tightening nut, a screw, or other suitable constricting device. The internal paths from the percussion caps to the shock tube can either be straight bore path from one percussion cap to one shock tube opening, or a cross-bored path that intersects or an expansion chamber to allow the explosion from one percussion cap to travel to both shock tube openings. In another instance, the shock tube adapter can be two pieces dissected horizontally creating two identical halves that snap or glue or screw together into a single piece. In this version, the shock tube adapter can have straight bore connects from the percussion caps to the shock tube, or a crossed-bored path or expansion chamber as previously described.

Figure 6:
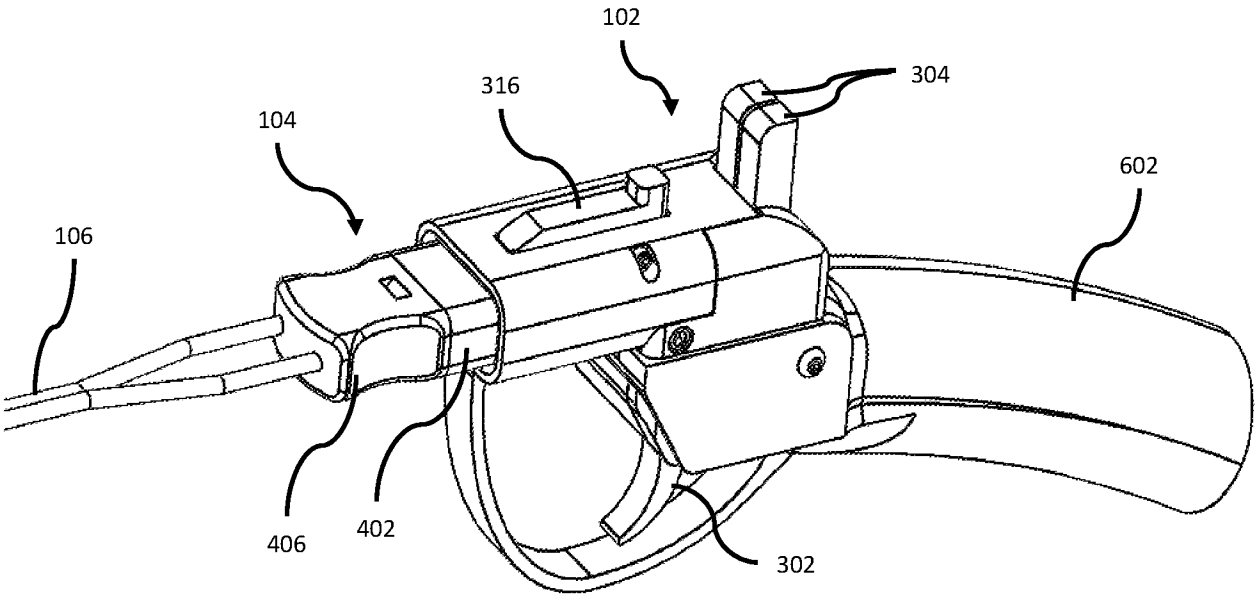
FIG. 6 is a perspective view depicting the shock tube adapter connected to the firing actuator, in accordance with certain examples.
Figure 7:
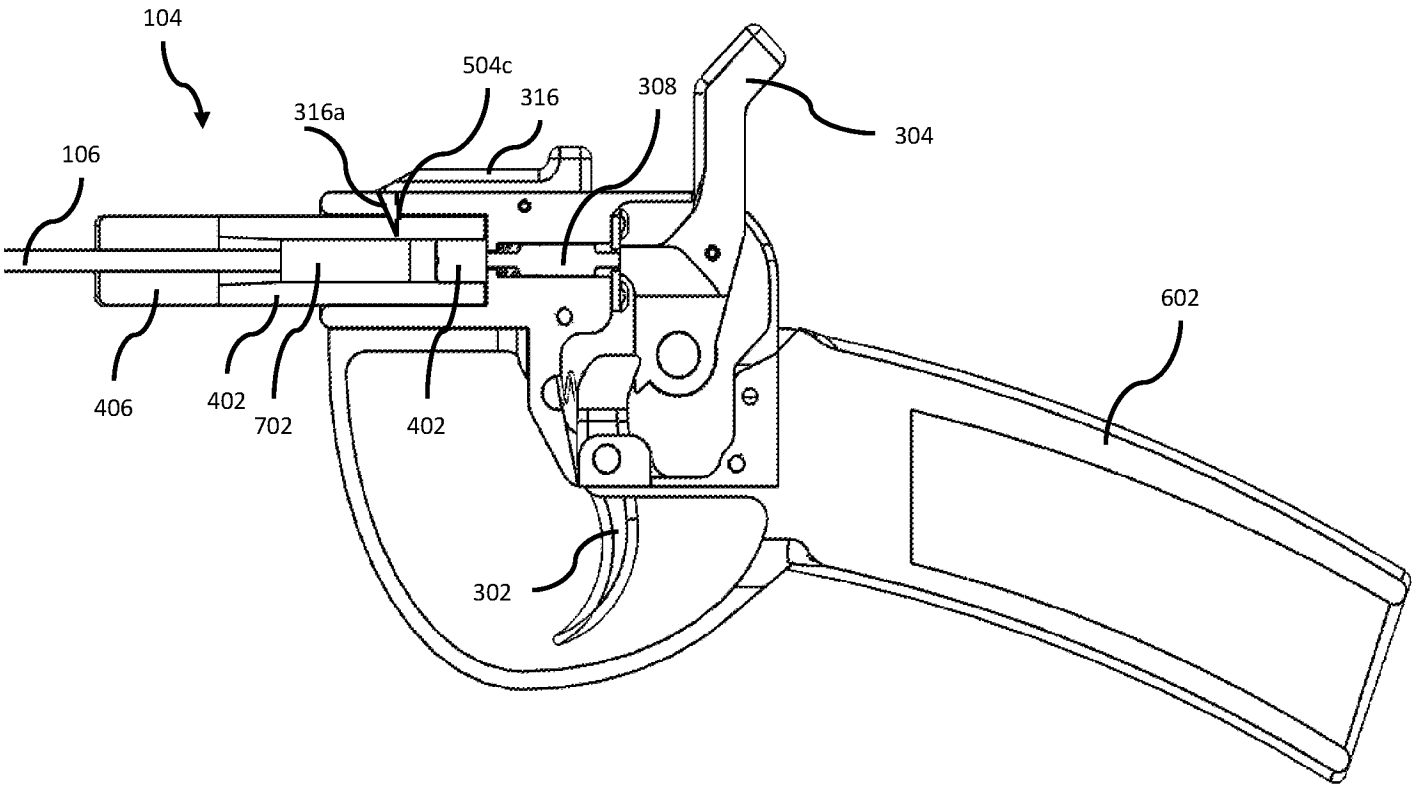
FIG. 7 is a cross-sectional view depicting the shock tube adapter connected to the firing actuator, in accordance with certain examples.

FIGS. 6 and 7 depict the shock tube adapter 104 engaged with the firing actuator 102. FIG. 6 is a perspective view depicting the shock tube adapter 104 connected to the firing actuator 102, in accordance with certain examples. FIG. 7 is a cross-sectional view depicting the shock tube adapter 104 connected to the firing actuator 102, in accordance with certain examples.

The shock tube adapter 104 is inserted into the firing actuator 102 housing until the tab 316*a* of the ejection latch 316 of the firing actuator 102 engages the retaining indent 504*c* of the primer case 404 of the shock tube adapter 104.

Additionally, as shown in FIGS. 6 and 7, a stock 602 can be coupled to the firing actuator 102. The stock 602 may allow easier operation of the firing actuator 102 by the operator.

If only one primer 402 is loaded into the shock tube 106 adaptor, the firing actuator 102 will fire the single primer 402. If two primers 402 are loaded into the shock tube 106 adaptor, the firing actuator 102 will fire both primers 402.

The system can utilize two primers 402, two firing pins 308, two shock tubes 106, and two blasting caps to create redundancy in the system and to ensure detonation of the charge. This system is referred to as dual priming. However, the system can be single primed by using only one primer 402 and/or one shock tube 106 and/or one blasting cap.

In certain examples, the shock tube adapter 104 is formed from plastic.

Operation of the shock tube adapter 104 is similar in operation and design to a magazine in a conventional firearm. An operator may load the shock tube 106 and primers 402 into the shock tube adapter 104 and may load the shock tube adapter 104 into the firing actuator 102.

The hammers 304 are cocked, and then the shock tube adaptor 104 is loaded into the firing actuator 102, and the firing device is initiated when the operator pulls the trigger 302. The trigger 302 releases the hammers 304, which cause the two firing pins 308 to engage the primers 402 to ignite the shock tube 106.

Figure 8:
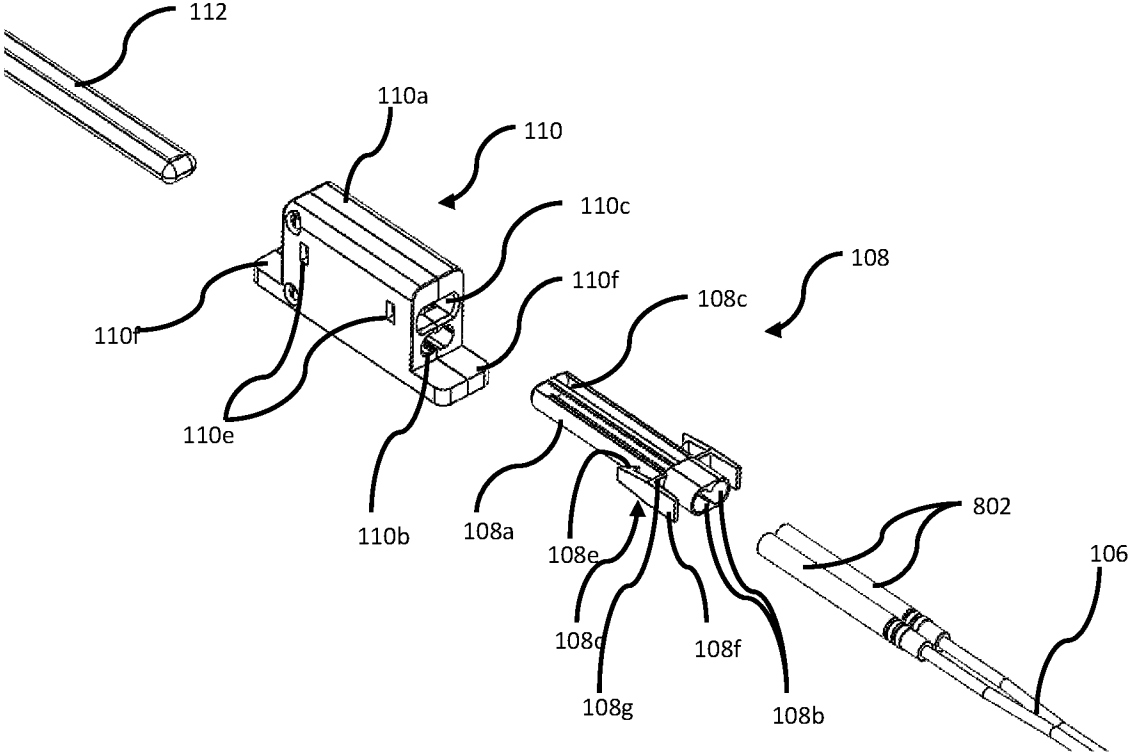
FIG. 8 is an assembly diagram depicting the blasting caps, cap box, priming well, and detonating cord in position for assembly, in accordance with certain examples.
Figure 9:
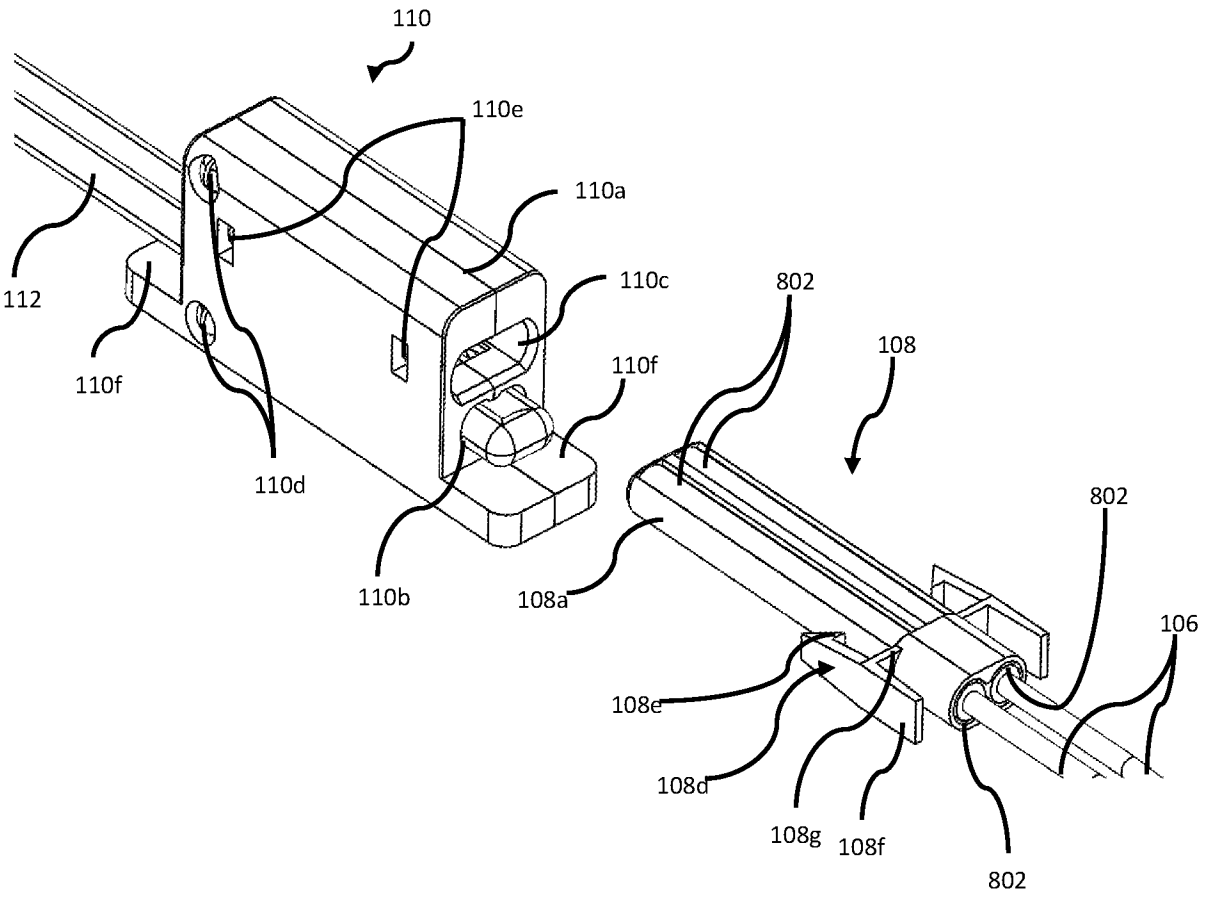
FIG. 9 is an assembly diagram depicting insertion of the detonating cord in the priming well and insertion of the blasting caps in the cap box, in accordance with certain examples.
Figure 10:
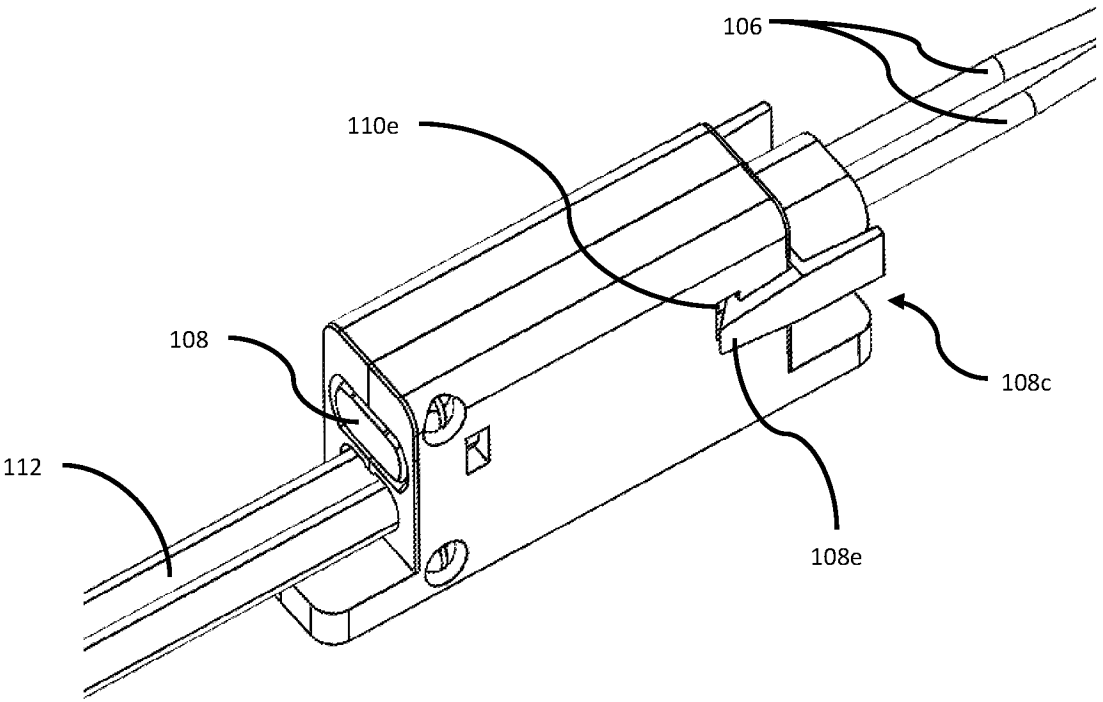
FIG. 10 is an assembly diagram depicting the blasting caps/cap box and the detonating cord inserted into the priming well, in accordance with certain examples.
Figure 11:
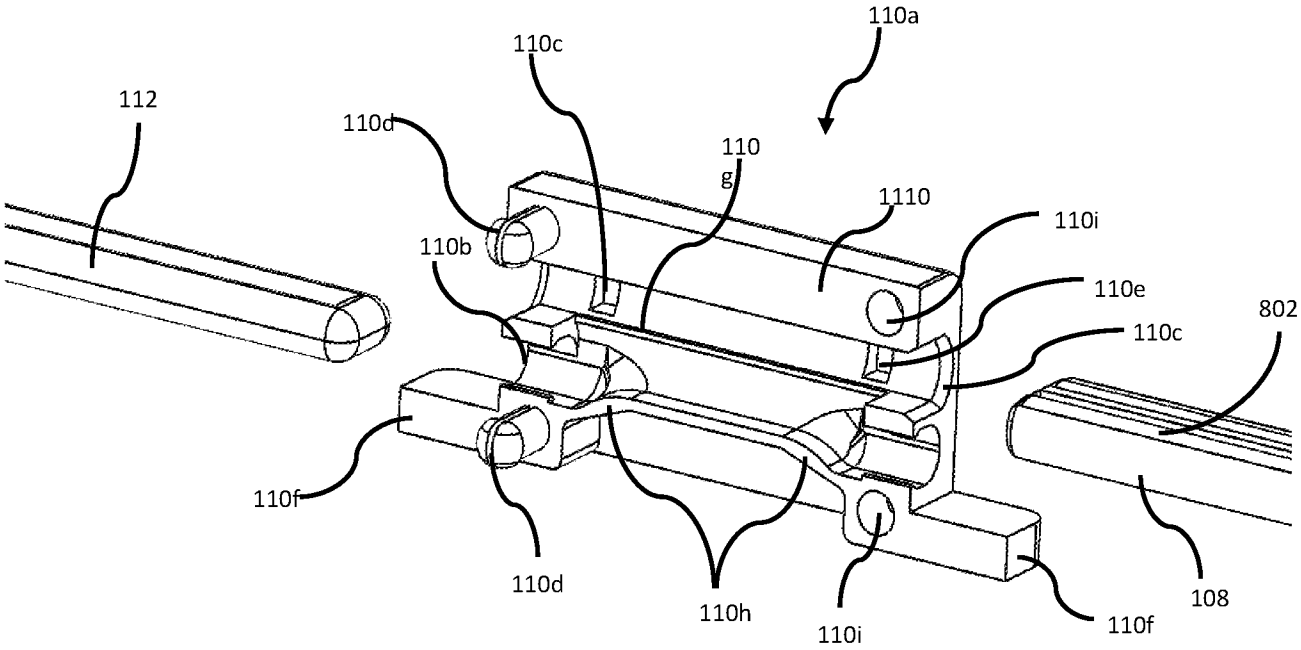
FIG. 11 is a perspective view of one half of a priming well, in accordance with certain examples, in accordance with certain examples.

The priming well 110 will now be described with reference to FIGS. 8-11. FIG. 8 is an assembly diagram depicting the blasting caps 802, cap box 108, priming well 110, and detonating cord 112 in position for assembly, in accordance with certain examples. FIG. 9 is an assembly diagram depicting insertion of the detonating cord 112 in the priming well 110 and insertion of the blasting caps 802 in the cap box 108, in accordance with certain examples. FIG. 10 is an assembly diagram depicting the blasting caps/cap box 108 and the detonating cord 112 inserted into the priming well 110, in accordance with certain examples. FIG. 11 is a perspective view of one half of a priming well 110, in accordance with certain examples.

The blasting caps 802 are attached to an end of the shock tube 106. For example, the blasting caps 802 can be crimped to the end of the shock tube 106.

The blasting caps 802 are inserted in to the cap box 108. The cap box 108 allows connecting and disconnecting the blasting caps 802 into the priming well 110. The cap box 108 also protects the blasting caps 802 during storage and/or transport. Although not depicted in FIG. 8, the cap box can comprise the removeable cap or other cover that further covers and protects the blasting caps from being struck during transport. This protection can maintain the blasting caps 802 in proper working condition. This protection also can prevent an inadvertent detonation of the blasting caps 802 by accidental contact or abuse.

The cap box 108 comprises a cap box housing 108*a* having apertures 108*b* extending from a first end of the cap box housing 108*a* through the cap box housing 108*a*. The apertures 108*b* are open to an exterior of the cap box housing 108*a* as shown by reference numeral 108*c*. A second end of the cap box housing 108*a* is closed. However, the apertures 108*a* may continue through the second end of the cap box housing 108*a*.

The blasting caps 802 are inserted into the apertures 108*b* of the cap box housing 108*a* until the blasting caps 802 are positioned inside the cap box housing 108*a*. The cap box housing 108*a* may retain the blasting caps 802 via compression fit. The cap box housing may also, or alternatively, retain the blasting caps 802 via retaining tabs (not depicted in FIGS. 8-11) located at the opening of the apertures 108*b* into the cap box housing 108*a*. In this case, the blasting caps 802 move the retaining tabs outward during insertion of the blasting caps 802 into the cap box housing 108*a*, and the tabs spring around the end of the blasting caps 802 to hold the blasting caps 802 in position.

The cap box 108 further comprises one or more cap box retaining latches 108*d* coupled to the cap box housing 108*a*. The cap box retaining latches 108*d* can be integrally formed with the cap box housing 108*a* and connect to the cap box housing 108*a* at a pivot point 108*g*. The cap box retaining latches 108*d* further comprise a locking tab 108*e* at one end. The cap box retaining latches 108*d* may further comprise a lever tab 108*f*. Actuation of the lever tab 108*f* moves the cap box retaining latch 108*d* about the pivot point 108*g* to move the locking tab 108*e* away from the cap box housing 108*a*.

In certain examples, the cap box 108 is a single, plastic part that houses the two blasting caps 802 and the end of the shock tube 106. The cap box 108 may be 3D printed or produced by any other plastic manufacturing process.

The cap box 108 serves at least three purposes. First, the cap box 108 provides a quick connect/disconnect to insert the blasting caps 802 into the priming well 110. Second, the cap box 108 protects the ends of the blasting caps 802, which are subject to exploding when struck on a hard surface. The cap box also can be inserted into a protective cover in a fast, disconnectable fashion.

The top and bottom of the cap box 108 are typically left open to allow the blasting caps 802 to have intimate contact with the detonating cord 112 when the cap box 108 is inserted into the priming well 110. The contact allows the blasting caps 802 to ignite the detonating cord 112 more efficiently and reliably. However, the top and bottom of the cap box 108 do not have to be left open for the system to operate.

The priming well 110 comprises a priming well housing 110*a* having a continuous aperture 110*b* and a continuous aperture 110*c* extending therethrough. The aperture 110*b* receives the detonating cord 112. The aperture 110*c* receives the cap box 108. The apertures 110*b* and 110*c* are oriented such that insertion of the detonating cord 112 in aperture 110*b* and insertion of the cap box 108 in the aperture 110*c* places the detonating cord 112 and the blasting caps 802 in proximity to each other. The detonating cord 112 may contact the blasting caps 802 or otherwise be located at a distance that will allow detonating of the blasting caps 802 to ignite the detonating cord 112.

The priming well 110 further comprises one or more indents (or apertures) 110*e* that receive the lever tab 108*f* of the cap box latch 108*d* as the cap box 108 is inserted into the aperture 110*c* of the priming well 110. In this manner, the cap box 108 can be inserted in and retained by the priming well 110. Additionally, the cap box 108 can be removed from the priming well 110 by action of the lever tab 108*f* away from the priming well 110 to release the lever tab 108*e* from the indent 110*e* of the priming well 110.

The priming well housing 110*a* may comprise protrusions 110*f* extending from the priming well housing. These protrusions 110*f* can facilitate attaching the priming well 110 to the detonating cord 112, the main explosive charge 114, or other fixture near the desired location. For example, zip ties, straps, plastic tape, rope, or other suitable material may be utilized with the protrusions 110*f* to hold the priming well 110 in a desired position.

As shown in FIGS. 9-11, the priming well 110 can be formed in two halves, whereby the housing 110*a* comprises two components 1110 configured to attach together to form the priming well housing 110*a*. Each component 1110 may comprise one or more locking tabs 110*d* that mate with another component 1110 to lock the two halves 1110 together. FIG. 11 depicts one-half 1110 of a two-piece priming well 110 in more detail. In addition to the priming well 110 components discussed previously, FIG. 11 depicts additional features internal to the priming well 110.

Each component 1110 of the priming well housing 110*a* also comprises retaining apertures 110*i* that receive corresponding locking tabs 110*d* of the other component 1110 of the priming well housing 110*a* to lock the two halves of the priming well housing 110*a* together. The apertures 110*b* and 110*c* are open to each other internally in the priming well 110 as shown by reference number 110*g*. This opening allows the detonating cord 112 to be positioned in proximity to the blasting caps 802 when the detonating cord 112 and the blasting caps 802 are inserted into the priming well 110. Two components 1110 can be mated together to form the complete housing 110*a* of the priming well 110.

The aperture 110*b* comprises one or more sloping portions 110*h* that are angled toward the aperture 110*c*. As the detonating cord 112 is inserted into the aperture 110*b* of the priming well 110, the sloping portions 110*h* force the detonating cord 112 toward the blasting caps 802. The positioning can ensure that the detonating cord 112 is positioned in sufficient proximity to the blasting caps 802 to allow detonation of the detonating cord 112 by the blasting caps 802. The sloping configuration of the bottom of the priming well 110 forces the detonating cord 112 upward into close proximity to the blasting caps 802, which may include contact with the blasting caps 802. The close proximity and/or intimate contact created by the forcing together of the detonating cord 112 and the blasting caps 802 causes the ignition of the detonating cord 112 by the blasting caps 802 to be more reliable and efficient. The likelihood that the blasting caps 802 will fail to ignite the detonating cord 112 can be reduced.

The cap box 108 can be plugged into the priming well 110 from any orientation and direction allowing the operator to quickly and intuitively connect the entire explosive system and back away to a safe location. The priming well 110 is designed with redundant configurations on both ends of the priming well 110. Accordingly, the operator may insert the cap box 108 in either end of the priming well 110 and may insert the detonating cord 112 in either end of the priming well 110. A simpler design also is suitable. For example, the priming well 110 can be configured on one end to receive only the cap box 108 and on another end to receive only the detonating cord 112.

The priming well 110 can retain the detonating cord 112 via a compression fit. For example, an area of the aperture 100*b* can taper to a smaller area inside the priming well 110 such that insertion of the detonating cord 112 compresses the detonating cord 112 inside the aperture 110*b*. Another method of securing the detonating cord comprises annular ridges along the length of the detonation chord path through the priming well 110 to physically engage the detonation cord.

Other configurations of the priming well 110 are suitable. For example, if the cap box 108 is not used, the aperture 110*c* can be sized to directly accommodate the blasting caps 802. The blasting caps 802 and/or the cap box 108/blasting caps 802 combination can be stored and/or transported in the priming well 110. In this manner, the priming well 110 can protect the blasting caps 802 during storing and or transport. The aperture 110*b* can be formed without the sloping portions 110*h*. In this case, the apertures 110*b* and 110*c* can be formed such that the detonating cord 112 and blasting caps 802 are positioned in suitable proximity without forcing the detonating cord 112 toward the blasting caps 802. The priming well 110 can be formed without the protrusions 110*f*. The priming well 110 can be formed as a single-piece construction.

Figure 12:
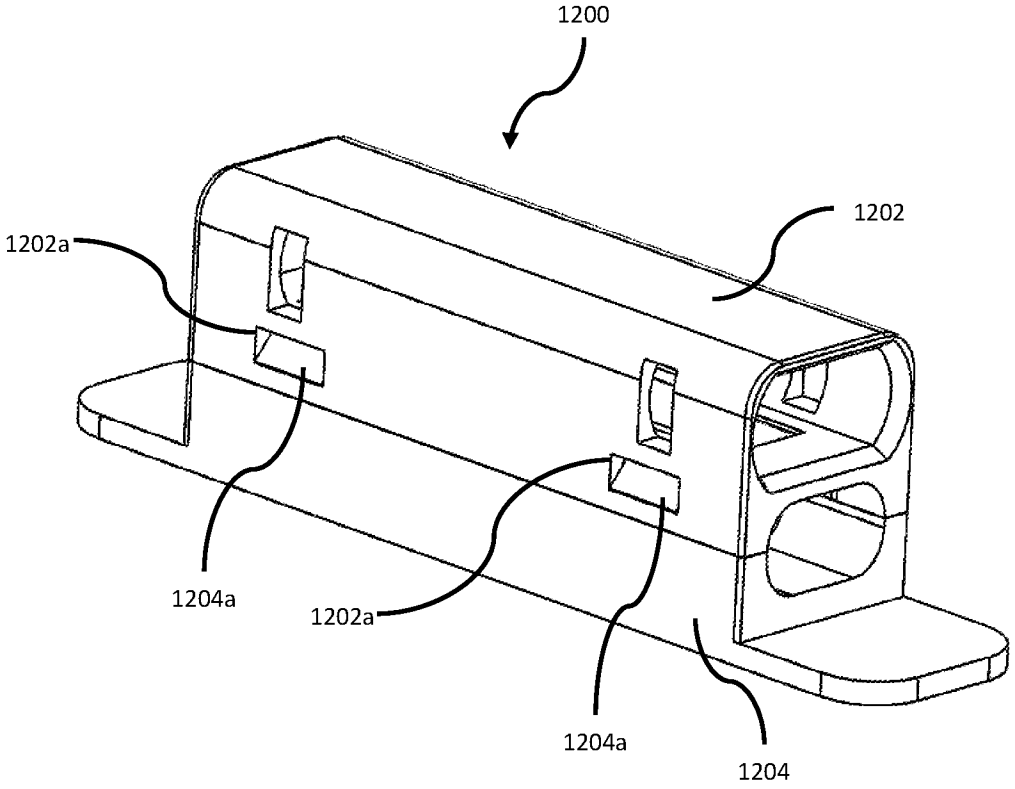
FIG. 12 is a perspective view depicting a low profile version of a priming well, in accordance with certain examples.
Figure 13:
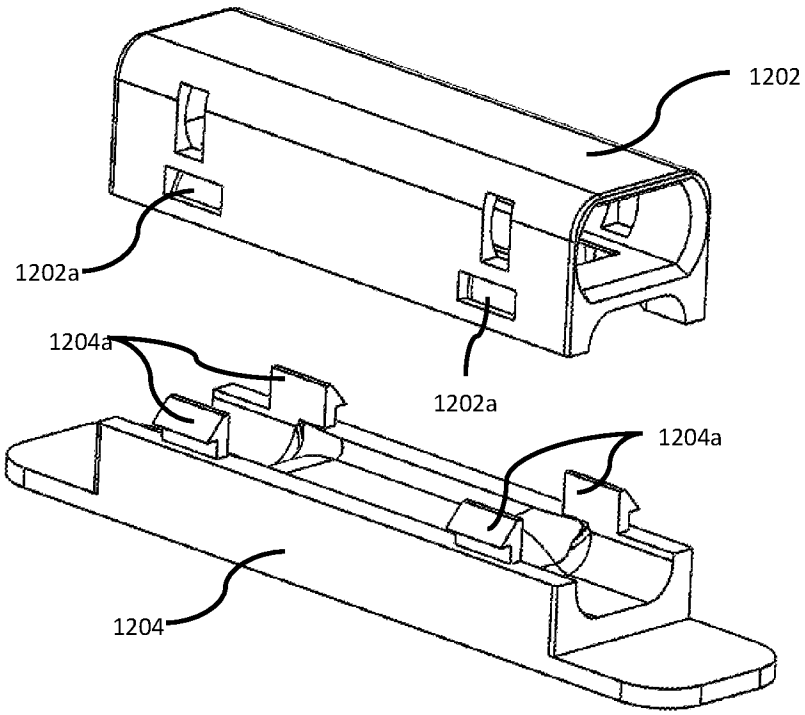
FIG. 13 is an exploded view depicting the components of the low profile priming well of FIG. 12, in accordance with certain examples.

FIGS. 12 and 13 depict an alternative construction of the priming well 110. FIG. 12 is a perspective view depicting a priming well 1200, in accordance with certain examples. FIG. 13 is an exploded view depicting the components of the priming well 1200 of FIG. 12, in accordance with certain examples.

The priming well 1200 comprises an upper housing 1202 and a lower housing 1204. Apertures 1202*a* of the upper housing 1202 receive tabs 1204*a* of the lower housing 1204 as the upper housing 1202 and the lower housing 1204 are mated together. The tabs 1204*a* engage the apertures 1202*a* to connect the upper housing 1202 and the lower housing 1204. The upper housing 1202 and the lower housing 1204 can be disconnected from each other by pushing the tabs 1204*a* into the apertures 1202*a* to release the engagement.

The priming well 1200 further comprises the features discussed previously with reference to FIGS. 8-11, except for the components that connect the two halves of the priming well housing.

In operation of the explosive detonating systems 100 described herein, the detonating cord 112 from the main explosive charge 114 is inserted into the priming well 110. In a typical configuration, the priming well 110 is attached to, or hanging from, the main charge.

The operator plugs the cap box 108 into the priming well 110. The operator plugs the shock tube adapter 104 into the firing actuator 102. The firing actuator 102 is unable to initiate the firing system until all of the components of the full system are connected to one another in the described manner and the hammers 304 are cocked.

The explosive detonating system 100 allows the operator to quickly connect/disconnect from the explosive system at two critical interfaces, at the shock tube adapter 104 and at the priming well 110. Only when the entire system is fully assembled (typically at the desired location for the explosion) is the system ready (or capable) for operation. This configuration allows for safer transport and storage of the system. In contrast, conventional systems are configured before transportation to a desired location because the components do not disassemble.

To initiate the system, the operator assembles the components as described above. The operator affixes the detonating cord 112 from the priming well 110 to the main explosive charge 114. The operator transports the firing actuator 102 away from the main explosive charge 114 to a distance controlled by the length of the shock tube 106. For example, the operator may use twenty feet of shock tube 106 to allow the operator to pull the trigger 302 of the firing actuator 102 twenty feet away from the main charge. Therefore, when the main charge explodes, the operator is in a safer location.

Although described herein as "shock tube" 106, any suitable stand-off device may be utilized. For example, the stand-off device can be electrical wire, shock-tube, time fuse, detonating cord, or other suitable stand-off device.

In alternate examples, the firing actuator can be actuated via a remote laser, or other remote signaling technology, such as radio frequency or infrared. For example, the firing actuator houses a laser or radio frequency (RF) system or a combination of both having an encoded signal. The shock tube adapter comprises a laser and/or RF receiver. This configuration allows the operator to remotely detonate the explosives from a safer distance from the explosives.

The remote device can have the same mechanical mechanism that the firing actuator described herein provides, including two striking mechanisms. However, instead of attaching the hand-held firing actuator and then being tethered to the charge, the remote device is activated with a coded signal on the hand-held device.

The charge is single or double primed, then the remote device is cocked. Then, a light illuminates to show the operator that the remote device is active. The operator connects the remote device to the shock tube adapter. The operator moves to a safe location and aims the hand-held device at the remote device and transmits the encoded signal from the hand-held device. The remote device may be configured to change to another color (red) and flash three times before activating the explosive charge.

The remote device provides multiple benefits. First, this device allows the operator to make adjustments that the shock tube may not be able to reach, thus, allowing the operator some flexibility in choosing a better cover position. Second, this device can have a time delay mode, so the operator can place the charge in one location and activate it, then move to another location and place another charge. When activated, the time delay prevents detonation for a configured amount of time or until the encoded signal is transmitted. This capability gives the operator much more flexibility.

Further, conventional systems limit the distance that an operator must be from the explosion based on the length of shock tube used in the charge. For example, if ten feet of shock tube is used between the shock tube adapter and the cap box, then the operator is only able to fire the system from approximately ten feet away. Additionally, shock tube can become tangled, which may limit or prevent its effective operation. In this alternative example, the operator may only require six inches of shock tube because the operator is able to trigger the system from any distance afforded by the effective range of the coded signal. Furthermore, if the signal is an RF signal, they can effectively initiate the device without being in the line of sight. Additionally, an RF signal would work through smoke, dust, fog, and/or heavy rain.

This encoded signal system securely allows a placed charge to be detonated from much greater distances than is practical with shock tube during breaching operations. It can also better facilitate coordinated or command controlled situations. The effect of larger distances between personnel and detonations reduces the physical effects of the blast on personnel and can allow better cover and concealment thereby increasing safety.

The Remote Firing Device System (RFDS) uses a hand-held Transmitter Device (TD) that, upon illuminating a target on a charge that is equipped with a like coded Receiver-Detonator, detonates the charge. To avoid certain jamming techniques employed against the system, in certain operations, the RFDS utilizes a specific frequency containing a transmitted code.

During operations, the Receiver-Detonator (R-D) is not armed until the charge is placed in the desired location. The operator turns the power button to "On," and a light will illuminate the receiver window. The operator cocks the R-D, and the light will change color or intensity. Only then will the operator connect the R-D to the charge. Once the charge has been placed and the remote detonator is armed, the operator can move away from the charge to a position of safety. From a safe position the operator can activate the R-D unit by aiming the encoded transmitting device at the R-D and transmit the encoded initiation signal. Once the R-D receives the code, it will activate a second count down to detonation.

The Remote Firing Device System consists of two assemblies: First, A Remote Firing Device (RFD) that emits the encoded detonating signal from a position of safety and concealment. The RFD contains the transmitter and driving electronics to send a preprogrammed secure firing code to the remote detonator. The firing device will look and act much like a small hand gun to allow the transmitter to be aimed. Second, A Receiver-Detonator (R-D) that ignites an electric spark, initiates an electronic trigger, or actuates an electronically secured spring actuator which engages a firing pin to strike a percussion cap and ignite a redundant or single shock tube. The shock tube is attached to a standard blasting cap. The shock tube can be of any length allowing the placement of the R-D in a position that can be viewed from position of cover and concealment for detonation.

Certain components of the systems described herein can be combined with portions of other systems and still achieve benefits of the described systems. For example, the priming well can be incorporated into a system using a conventional firing device or other firing device. In this case, the system may be connected and disconnected between a fire mode and a safe mode by connecting and disconnecting the blasting caps from the priming well and/or the detonating cord from the priming well. Additionally, the shock tube adapter can be incorporated into a system using a conventional method and components to connect the blasting caps to the detonating cord. In this case, the system may be connected and disconnected between a fire mode and a safe mode by connecting and disconnecting the shock tube adapter from the firing device and/or the shock tube case from the priming well case.

The components and systems described herein can be formed of any suitable material. A person having ordinary skill in the art and the benefit of this disclosure will understand that multiple options exist for manufacturing the components and systems described herein. For example, the components may be formed of plastic and injection molded, 3-D printed, or otherwise formed is integral or multi-component parts. The components also may be formed partially or entirely of other materials, such as metals. Individual components described herein may be formed of multiple parts formed from the same or different materials and assembled together.

The example systems, methods, and components described in the embodiments presented previously are illustrative, and, in alternative embodiments, certain components can be combined in a different order, omitted entirely, and/or combined between different example embodiments, and/or certain additional components can be added, without departing from the scope and spirit of various embodiments. Accordingly, such alternative embodiments are included in the scope of the following claims, which are to be accorded the broadest interpretation so as to encompass such alternate embodiments.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of the present disclosure, without departing from the spirit and scope of the invention defined in the following claims, the scope of which is to be accorded the broadest interpretation so as to encompass such modifications and equivalent structures.

What is claimed is:

1. A priming well to couple blasting caps to detonating cords, comprising:

a housing comprising:

a first aperture extending into the housing and configured to receive a detonating cord, a second aperture extending into the housing and configured to receive a blasting cap, the second aperture overlapping the first aperture inside the housing; and a cap box configured to receive the blasting cap therein, wherein the second aperture of the housing is configured to receive the blasting cap by being configured to receive the cap box.

2. The priming well of claim 1, the first and second apertures being open to each other at an overlapping portion of the first and second apertures inside the housing.

3. The priming well of claim 1, the first aperture sloping toward an overlapping portion of the second aperture inside the housing.

4. The priming well of claim 1, the first aperture sloping toward and intersecting with an overlapping portion of the second aperture inside the housing.

5. The priming well of claim 1, the housing comprising a first component and a second component that snap together to form the housing, the first component comprising at least a portion of the first aperture therein, and the second component comprising the second aperture therein.

6. The priming well of claim 1, the housing comprising two components that snap together to form the housing, wherein the two components of the housing are the same.

7. The priming well of claim 1, wherein the cap box comprises an aperture extending into the cap box and configured to receive the blasting cap.

8. The priming well of claim 7, wherein the aperture of the cap box is configured to retain the blasting cap via a compression fit.

9. The priming well of claim 7, the cap box further comprising a retaining tab moveable from a position in front of an entrance of the aperture in the cap box to a position away from the entrance of the aperture in the cap box.

10. The priming well of claim 9, the retaining tab comprising a spring force, the spring force biasing the retaining tab to the position in front of the entrance of the aperture in the cap box and allowing movement of the retaining tab against the spring force and away from the entrance of the aperture in the cap box.

11. The priming well of claim 7, wherein overlapping sections of the first aperture in the housing, the second aperture in the housing, and the aperture in the cap box are open to each other inside the housing.

12. The priming well of claim 1, further comprising the blasting cap.

13. The priming well of claim 1, the cap box and the priming well comprising corresponding retention components that engage when the cap box is inserted into the priming well to retain the cap box in the priming well.

14. The priming well of claim 13, the corresponding retention components comprising at least one tab on the cap box and at least one indent on the housing, each at least one tab of the cap box engaging a corresponding one of the at least one indent of the housing to retain the cap box in the priming well.

15. The priming well of claim 13, wherein the retention components releasably retain the cap box in the priming well.

16. The priming well of claim 1, further comprising a cap box comprising a first aperture in the cap box configured to receive a first blasting cap and a second aperture in the cap box configured to receive a second blasting cap, wherein the second aperture of the housing is configured to receive the blasting cap by being configured to receive the cap box.

17. A priming well to couple blasting caps to detonating cords, comprising:

a cap box comprising an elongated aperture configured to receive a blasting cap, the elongated aperture comprising a section along a length of the aperture that is open to an external side of the aperture; and a housing comprising a first elongated aperture extending into the housing and configured to receive an detonating cord and a second elongated aperture extending into the housing and configured to receive the cap box, the first elongated aperture overlapping the second elongated aperture internally in the housing, the first and second elongated apertures being open to each other at an overlapping portion along a length of the first and second apertures inside the housing, the first elongated aperture sloping toward the second elongated aperture inside the housing, the cap box insertable into the second elongated aperture of the housing, the cap box and the housing comprising corresponding retention components that engage when the cap box is inserted into the housing to releasably retain the cap box in the housing, wherein overlapping sections of the first elongated aperture in the housing, the second elongated aperture in the housing, and the elongated aperture in the cap box are open to each other inside the housing.

18. The priming well of claim 17, the housing comprising a first component and a second component that snap together to form the housing, the first component comprising at least a portion of the first elongated aperture therein, and the second component comprising the second elongated aperture therein.

19. The priming well of claim 17, the cap box further comprising a retaining tab positioned near an entrance of the aperture into the cap box, the retaining tab comprising a spring force, the spring force allowing the retaining tab to be moved away from the entrance of the aperture in the cap box during insertion of a blasting cap into the cap box, and the spring force biasing the retaining tab over an end of a blasting cap after insertion of a blasting cap into the cap box.

20. The priming well of claim 17, the cap box comprising a second elongated aperture extending into the cap box and configured to receive a second blasting cap.

* * * * *